United States Patent [19]

Mambretti

[11] 4,409,922

[45] Oct. 18, 1983

[54] V-SHAPED BOTTOM FOR SPEEDY MOTORBOATS HAVING IMPROVED PLANING SUPPORTING SKIDS

[76] Inventor: Riccardo Mambretti, Cascina Berina, 22070 Fenegro' (Como), Italy

[21] Appl. No.: 229,113

[22] Filed: Jan. 28, 1981

[30] Foreign Application Priority Data

Feb. 4, 1980 [IT] Italy ..... 19667 A/80

[51] Int. Cl.[3] ..... B63B 1/20

[52] U.S. Cl. ..... 114/283; 114/56

[58] Field of Search ..... 9/6 R, 6 P, 6 W, 6 M; 114/56, 57, 271, 283, 288, 289, 290, 291, 355–358

[56] References Cited

U.S. PATENT DOCUMENTS

| | | | |
|---|---|---|---|
| 2,234,899 | 3/1941 | Higgins | 114/290 |
| 3,137,261 | 6/1964 | Noe | 114/290 |
| 3,259,092 | 7/1966 | Kara, Jr. | 114/288 |
| 3,361,104 | 1/1968 | Glass | 114/290 |
| 3,991,698 | 11/1976 | Simpson | 114/288 |

FOREIGN PATENT DOCUMENTS

| | | | |
|---|---|---|---|
| 1288118 | 2/1962 | France | 114/290 |

*Primary Examiner*—Trygve M. Blix
*Assistant Examiner*—Jesús D. Sotelo

[57] ABSTRACT

A V-shaped bottom for speedy motorboats of the type provided with planing supporting skids, wherein said skids have the supporting planing surface thereof rising from the bow towards the stern and gradually projecting from the section of said bottom, each supporting surface having a triangular conformation and each being provided with side walls forming the attachment elements for said skid to said bottom, the height of said walls gradually increasing from the bow towards the stern.

2 Claims, 2 Drawing Figures

V-SHAPED BOTTOM FOR SPEEDY MOTORBOATS HAVING IMPROVED PLANING SUPPORTING SKIDS

The invention relates to a V-shaped bottom for speedy motorboats having improved planing supporting skids.

In sport motorboating, the most widely used motorboat bottoms are those more or less deep V-shaped and having a longitudinal planing supporting skids. Such a V-shaped bottom provides undoubted advantages since it is smooth in impact against waves, both at front as well as during the 'drop down' upon separation of the boat from the water surface; it is stable both tranversely and longitudinally being self-stabilizing due to the supporting skids and due to the same V-shaped conformation; and it is speedy since by decreasing the power applied to the boat, the friction surface is gradually reduced because of the reduction in the 'wetted' bottom triangle due to the V-shape of the latter and of the speed effect.

Conventional planing supporting skids allow to increase the speed up to a certain value depending on the boat weight and propelling power applied thereto.

It is the object of the present invention to provide a V-shaped motorboat bottom having improved planing supporting skids enabling a higher speed under the same conditions of boat weight and propelling power.

This and further objects of the invention will become apparent to those skilled in the art from the following description and appended claims.

According to the invention, a V-shaped bottom for speedy motorboats of the type provided with planing supporting skids, is essentially characterised in that said skids have the supporting surface thereof completely projecting from the section of said bottom.

According to a further characteristic feature of the invention, along the longitudinal edges of the supporting surface of each skid there are provided side walls forming the attachment element for said skid to said bottom.

As well known, a V-shaped bottom provides satisfactory results up to a certain limit, beyond which it is first slowed down and then reaches a limit point in that the wetted (or friction) surface is no longer capable of decreasing, or at least it decreases with a substantial increase in the applied power and, accordingly, with consumptions and costs which are antieconomical proportionally to the increased performance obtained.

At low speeds (up to 17–20 knots), a bottom provided with the planing supporting skids according to the invention will behave just as a normal V-shaped bottom the boat not yet having reached a speed enabling it to plane upon the surface of the water.

At medium speeds (from about 17 to 45 knots and more) the improved planing skids confer to the related bottom a gradually increasing efficiency if compared to a normal V-shaped bottom, with the additional advantage that when propellers rotating in the same direction are used, the torque generated by said propeller rotation less effects the course of the boat, since the side walls of each skid behave as a fin keel.

At high speeds, and as said speeds gradually increase, the improved planing skids proposed by the present invention allow to increase the skid lift, so as to substantially reduce the 'wetted' triangle with a resulting proportional increase in the boat speed at same power.

By increasing the boat speed and drawing nearer the longitudinal supporting skids to the center keel, the boat performance can be further increased.

It is another advantage that, when the boat bottom is lifted by the carrying force of the longitudinal planing supporting skids projecting from the bottom, the propeller core (comprising either the astern foot, or the propeller shaft, or the propelling turbine, or any other propelling system) is at a higher level relative to the position of the conventional bottom, i.e. less deep, closer to the water surface: this involves the advantage of also providing a reduced hydrodinamic immersed braking action, which affords an additional increase in the boat speed.

The V-shaped bottom provided with the improved skids according to the invention is schematically shown in the accompanying drawings, wherein.

Figure 1:
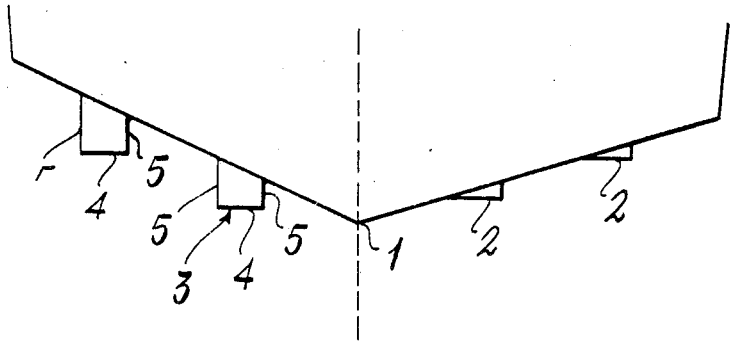
FIG. 1 illustrates the profile of the transom of a motorboat.
Figure 2:
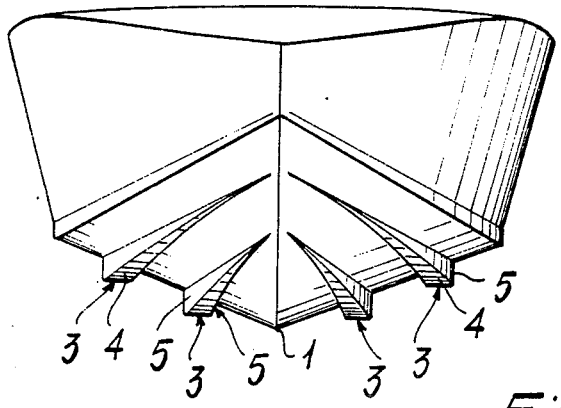
FIG. 2 is a front view (i.e. in the direction of the bow).

In FIG. 1, at the right side of the keel 1 the conventional skids 2 are shown, while at the left side the improved skids 3 according to the invention are shown. Unlike skids 2, the new proposed skids 3 have the supporting surface 4 completely projecting and defined along each edge by a side wall 5 for attachment to the bottom. As it appears from FIG. 2, each supporting surface 4 rises from the bow and gradually moves away from the bottom assuming a triangular conformation.

What I claim is:

1. A hull for a boat, said hull comprising:

two longitudinal surfaces which angle downwardly toward a central longitudinal line of the hull to define a v-shaped structure which extends from the bow of the boat to its stern; and at least two skids extending longitudinally with respect to said central line and projecting from said hull, said skids having two essentially vertical sidewalls and a supporting surface between said sidewalls and defining in cross section at least a portion of a polygon whose width is approximately equal to or less than its height, the height of said sidewalls and width of said supporting surface uniformly decreasing in dimension and thereby tapering to a point as said skids approach the bow of said boat.

2. A hull for a boat as in claim 1 wherein said sidewalls are parallel.

* * * * *